US006237395B1

(12) United States Patent
Helgeson

(10) Patent No.: US 6,237,395 B1
(45) Date of Patent: May 29, 2001

(54) ANNULAR AFTER REACTOR FOR USE WITH A JET ENGINE TEST CELL

(75) Inventor: Norman Lewis Helgeson, Pacific Palisades, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/436,715

(22) Filed: Nov. 8, 1999

(51) Int. Cl.[7] ..... G01N 25/00

(52) U.S. Cl. ..... 73/23.31; 116/117.1; 116/117.4; 116/865.6

(58) Field of Search ..... 73/23.31, 116, 73/117.1, 117.2, 117.3, 117.4, 865.6

(56) References Cited

U.S. PATENT DOCUMENTS 5,454,220 * 10/1995 Althaus et al. .
5,577,378 * 11/1996 Althaus et al. .
5,614,658 * 3/1997 Moss ..... 73/23.31
5,622,053 * 4/1997 Freen .
5,943,859 * 8/1999 Kawamura .

* cited by examiner

*Primary Examiner*—Eric S. McCall
(74) *Attorney, Agent, or Firm*—David Kalmbaugh

(57) ABSTRACT

An annular after reactor is aligned axially with the direction of exhaust flow from the exhaust port of jet engine undergoing static test. Located near the front end of the annular after reactor is a first set of gas injectors which extend inward into the interior of the after reactor. A second set of gas injectors which are located downstream from the first set of gas injectors also extend inward into the interior of the annular after reactor. The first set of gas injectors inject natural gas or other fuel into the exhaust flowing from the jet engine, while the second set of gas injectors inject ammonia into the exhaust from the jet engine. The natural gas when ignited substantially raises the temperature of the jet engine's exhaust which incinerates the particulate and other combustible matter in the exhaust. Ammonia when injected into the exhaust stream for the jet engine's exhaust functions as a reductant to eliminate up to 90% of the $NO_X$ compounds in the exhaust stream.

14 Claims, 5 Drawing Sheets

ANNULAR AFTER REACTOR FOR USE WITH A JET ENGINE TEST CELL

BACKGROUND OF THE INVENTION

1. Field of the Invention

The present invention relates generally to apparatus for testing jet engines. In particular, the present invention relates to an annular after reactor (AAR) positioned in the exhaust of a jet engine under static test to remove particulate matter and other environmentally unsafe compounds from the exhaust of the jet engine.

2. Description of the Prior Art

The National Ambient Air Quality Standards established by the Clean Air Act requires the removal of fine particle concentrations from the atmosphere in an effort to decrease lung disease and related illnesses as well as mortality rates in urban areas. Currently, the standards have a criteria of PM10 (particles smaller than 10 microns in diameter, however, a standard for PM2.5 is in the process of being imposed. In addition, the Clean Air Act provides for the promulgation of national emission standards for engine test facilities including jet engine test cells.

The emissions of particulate matter, nitrogen oxides ($NO_x$), carbon monoxide and unburned hydrocarbons from the engine exhaust from a jet engine under test has been a concern of the military for two decades, however a cost effective approach for reduction of these environmentally harmful emissions remains to be identified.

Further, the problems that must be addressed to control these emissions are considerable, including the following: (1) the pollutant must be removed from large quantities of engine exhaust as well the augmentation air that accompanies and mixes with the exhaust; (2) the exhaust gases move at velocities of up to 3000 ft/sec and have temperatures of up to 3000 degrees Fahrenheit; (3) the operational conditions of jet engine test cells change frequently so that steady state operation is difficult to achieve; (4) proper test conditions require that only a limited back pressure be developed in the test cell augmentation tube; and (5) the cost for treatment of an exhaust stream from a jet engine is proportional to the total exhaust gas flow and inversely proportional to the pressure drop permitted.

One prior art approach provided for the use of water sprays to remove particulate matter from the jet engine exhaust stream. However, the approach led to the creation of acidic fallout near the jet engine test cell. In addition, the use of water sprays to remove PM2.5 particulates (i.e., particulates of a size less than 2.5 microns in diameter) is generally ineffective since particulates of the order of 2.0 microns tend to follow streamlines around water droplets rather than be collected on them by impaction.

Other prior art approaches such as the use of a filter bed to remove particulate matter from jet engine exhausts have also been shown to be very ineffective and costly.

Accordingly, there is a need for a relatively simple, cost effective and highly efficient apparatus for the removal of particulate matter and other environmentally harmful compound from the exhaust of a jet engine under test.

SUMMARY OF THE INVENTION

The present invention overcomes some of the disadvantages of the prior art in that it comprises a relatively simple yet highly effective apparatus for removing particulate matter and other environmentally unsafe compounds from the exhaust of the jet engine being tested.

An annular after reactor, comprising an embodiment of the present invention, is aligned axially with the direction of exhaust flow from the exhaust port of jet engine. Located near the front end of the annular after reactor is a first set of gas injectors which extend inward into the interior of the after reactor. A second set of gas injectors which are located downstream from the first set of gas injectors also extend inward into the interior of the after reactor. The first set of gas injectors inject natural gas (or other fuel) into the exhaust flowing from the jet engine, while the second set of gas injectors inject ammonia into the exhaust from the jet engine.

The natural gas, when ignited, substantially raises the temperature of the jet engine's exhaust to a temperature range of between 1850° F. to 2200° F. and causes the incineration of the particulate matter in the exhaust. Ammonia, when injected into the exhaust stream of the jet engine's exhaust, functions as a reductant to eliminate up to 90% of the $NO_X$ compounds in the exhaust stream.

DETAILED DESCRIPTION OF THE PREFERRED EMBODIMENT

Figure 1:
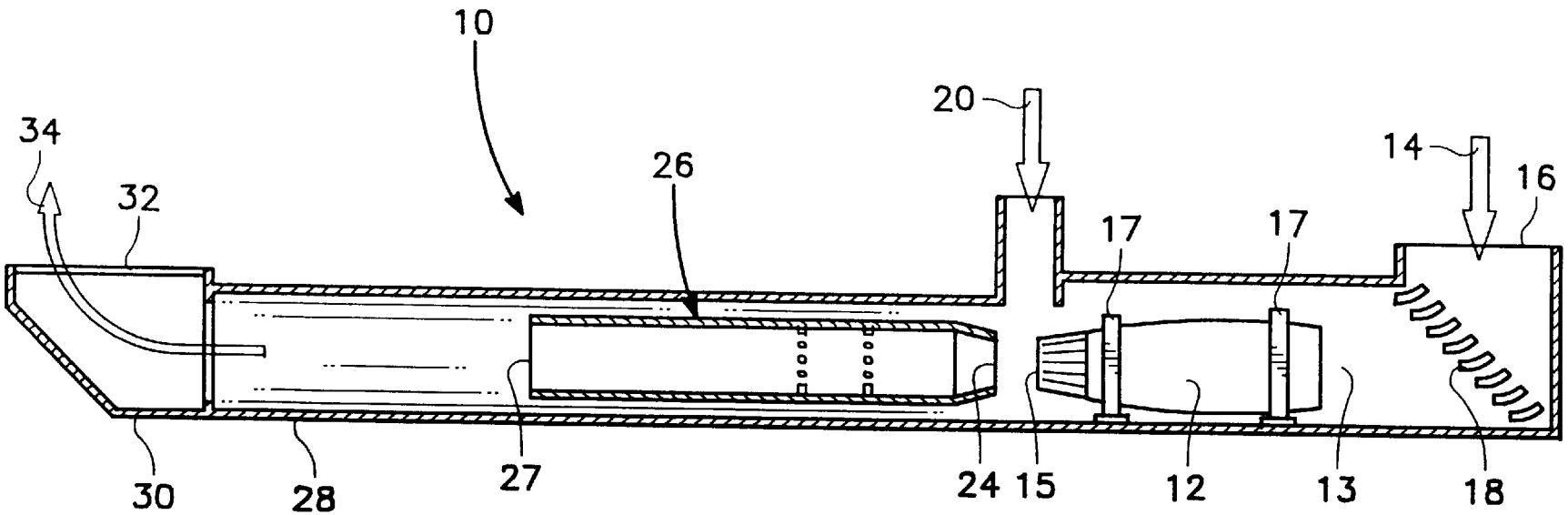
FIG. 1 is a plane side view of a jet engine test cell for testing a jet engine which includes the annular after reactor comprising the present invention.

Referring to FIG. 1 there is shown a jet engine test cell 10 which is used for testing a jet engine 12. The jet engine 12 under test emits particulate matter and other environmentally unsafe compounds such as NO, $NO_2$, CO and unburned hydrocarbons in its exhaust which must be removed from the exhaust prior to emitting the exhaust into the atmosphere.

Located in the forward portion of jet engine test cell 10 is a test chamber 13 which has the jet engine 12 under test mounted therein. A pair of straps 17 are used to secure jet engine 12 in a fixed position within test chamber 13. The front end of jet engine test cell 10 has a vertically positioned air intake port 16 which allows air to be drawn from the atmosphere into test chamber 13 (in the manner illustrated by arrow 14). Shaped louvers 18 positioned below air intake port 16 within test chamber 13 directs air drawn from the atmosphere toward the air intake of jet engine 12. Test chamber 13 of jet engine test cell 10 also has a vertically positioned air intake port 20 (in some test cell designs) located within its rear portion which allows air from the atmosphere into chamber 13 at the exhaust port or exhaust nozzle 15 of jet engine 12. It should be noted that arrow 20 indicates the direction of flow of air from the atmosphere through air intake port 20 to the exhaust port 15 of jet engine 12.

Located in the forward portion of the augmenter tube 28 of jet engine test cell 10 is an annular after reactor 26 which removes particulate matter, nitrogen oxides, and unburned hydrocarbons, and hydrocarbons from engine exhaust from jet engine 12 which is under test. It should be noted that annular after reactor 26 is aligned axially with the direction of exhaust flow from the exhaust port 15 of jet engine 12.

Jet engine exhaust exiting outlet port 27 of annular after reactor 26 flows through augmenter tube 28 to the exhaust stack 30 of jet engine test cell 10. The jet engine exhaust then exits test cell 10 through an outlet port 32 into the atmosphere (in the manner illustrated by arrow 34).

Figure 2:
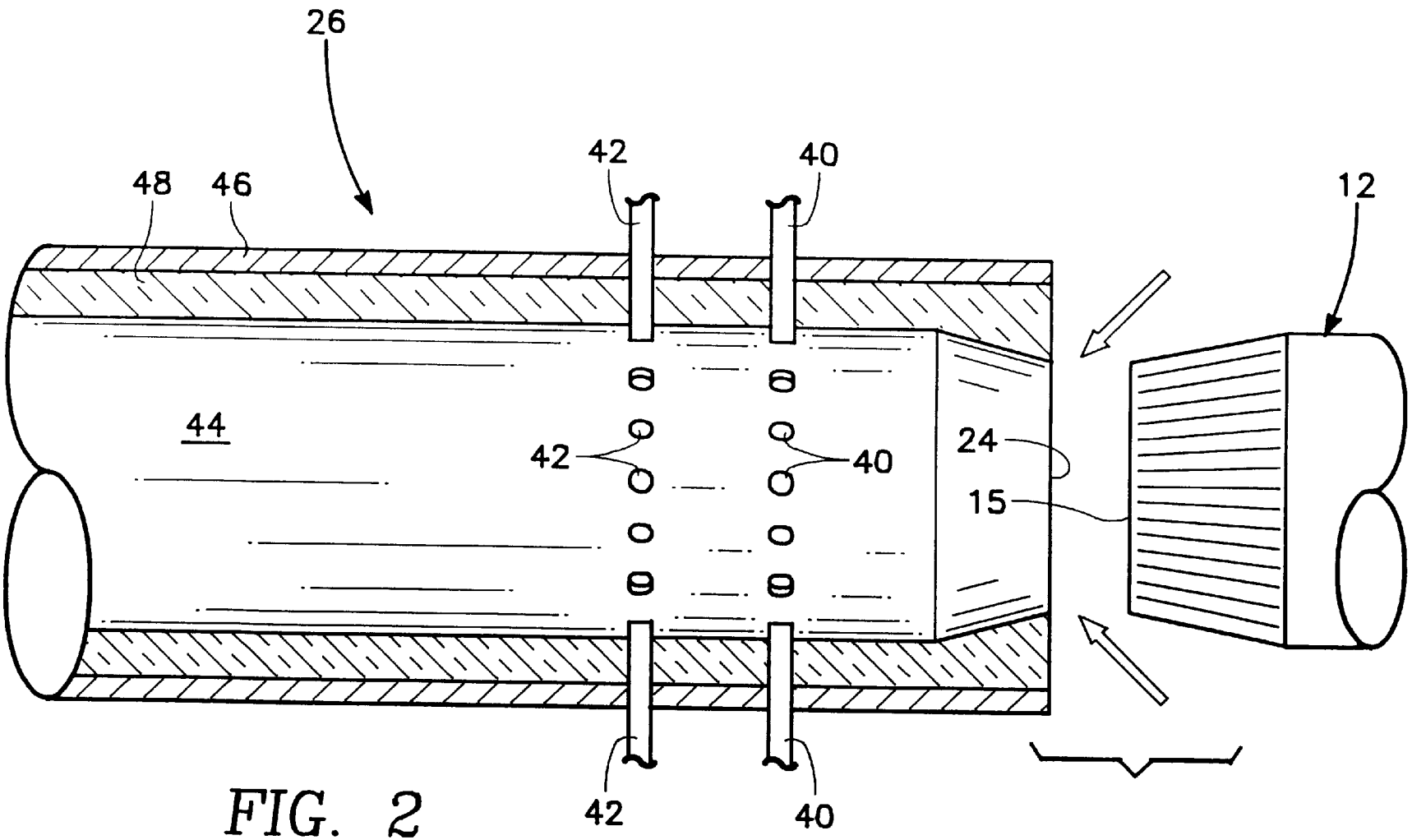
FIG. 2 is a plane view, in partial section, of the annular after reactor of FIG. 1.

Referring to FIGS. 1 and 2, there is shown a view, in partial section of the annular after reactor 26 which is an embodiment of the present invention. Annular after reactor 26, which is tubular in shape includes an outer casing 46 which is fabricated from steel pipe. Positioned inside of and affixed to casing 46 of after reactor 26 is a layer of ceramic material 48 which is also tubular in shape and provides a means for thermal protection. Thermal protection is required since the temperature from the jet engine's exhaust stream may range from about 460° F. for an idle jet engine to about 3000° F. for after burning.

The inlet 24 to annular after reactor 26 is shaped to function as a diffuser to reduce the velocity of jet exhaust exiting exhaust port of jet engine 12 as it enters annular after reactor 26. As the exhaust slows in the diffuser. the kinetic energy of the exhaust is recovered as pressure from the exhaust gases. This pressure is used to overcome the pressure losses within the after reactor and to reduce the back pressure developed in the after reactor 26 and in the augmenter tube 28.

There is also located near the front end of annular after reactor 26 is a first set of spoke-like injectors 40 which are perpendicular to ceramic material 48 and extend inward into the interior 44 of reactor 26. A second set of spoke-like injectors 42 are located downstream from the first set of spoke-like injectors 40. Like injectors 40, injectors 42 are perpendicular to ceramic material 48 and extend inward into the interior 44 of reactor 26. Injectors 40 inject natural gas (or other fuel) into the exhaust flowing from jet engine 12, while injectors 42 inject $NH_3$ ammonia into the exhaust from jet engine 12.

The natural gas when ignited substantially raises the temperature of the jet engine's exhaust and causes the incineration of the particulate matter in the exhaust. Ammonia when injected into the exhaust stream for the jet engine's exhaust functions as a reductant to eliminate up to 90% of the nitrogen oxides $NO_X$ compounds in the exhaust stream. $NO_X$ compounds eliminated by ammonia include nitric oxide NO and nitrogen dioxide $NO_2$.

Referring to FIGS. 2 and 3A–3C, details of for a typical injector for annular after reactor 26 are shown which includes the temperature augmenter 26' (illustrated in FIGS. 3A–3C)for injecting natural gas into the jet engine's exhaust stream. Augmenter 26' includes a tubular injection ring 54 vertically positioned within the interior 44 of annular after reactor 26. A pair of fuel feed lines 56 and 58 are connected to injection ring 54 to supply natural gas to injection ring 54 and also to provides the support structure for injection ring 54.

Figure 3A:
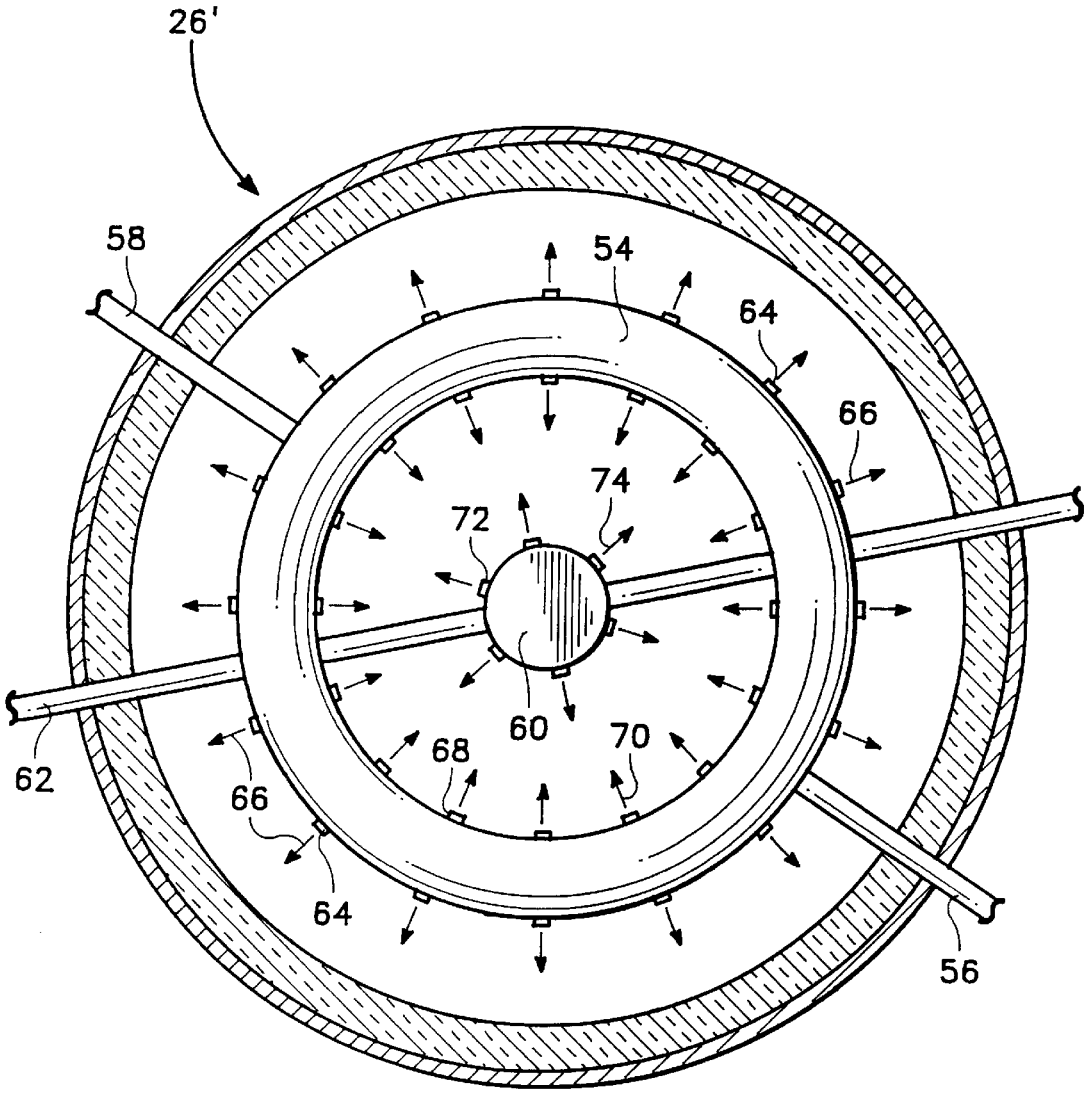
FIGS. 3A–3C are views typical of one of the two annular after-reactor temperature augmenters of the annular after reactor of FIG. 1.
Figure 3B:
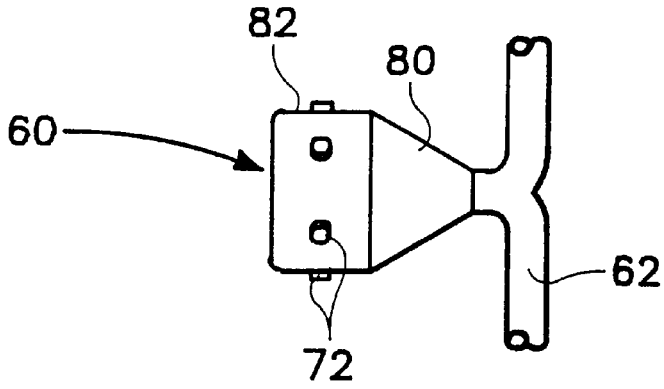

Injection ring 54 also has a plurality of equally spaced gas injection ports or nozzles 64 located around its outer circumference and a plurality of equally spaced gas injection ports or nozzles 68 located around its inner circumference. As shown in FIG. 3A, injection ring 54 includes a plurality of gas injection nozzles 64 which inject natural gas outwardly into the exhaust stream (as indicated by arrows 66) and a plurality of gas injection nozzles 68 which inject natural gas outwardly into the exhaust stream (as indicated by arrows 70).

Temperature augmenter 26' also has a centrally located gas injection device 60 which includes six equally spaced gas injection nozzles 72 (typical) positioned around its circumference to inject natural gas into the exhaust stream of jet engine 12 in the manner indicated by arrows 74. A centerpiece fuel feed line 62 is connected to device 60 supplying natural gas to device 60. Feed line 62 is also used to position device 60 centrally within augmenter 26' and to provide support for device 60. Gas injection device 62 comprises a cone shaped rear portion 80 and a cylindrical shaped forward portion 82 which includes equally spaced gas injection nozzles 72.

At this time it should be noted that the present invention may utilize only one augmenter (as shown in FIG. 3A) to raise the temperature of the jet engine's exhaust to between 1850° F. to 2200° F. which will incinerate the particulate matter in the jet engine's exhaust. As an alternative, the apparatus of the present invention may include a second augmenter of the type illustrated in FIG. 3A to inject ammonia into the exhaust from jet engine 12. Ammonia when injected into the exhaust stream for the jet engine's exhaust again functions as a reductant to eliminate up to 90% of the $NO_X$ compounds in the exhaust stream.

Figure 3C:
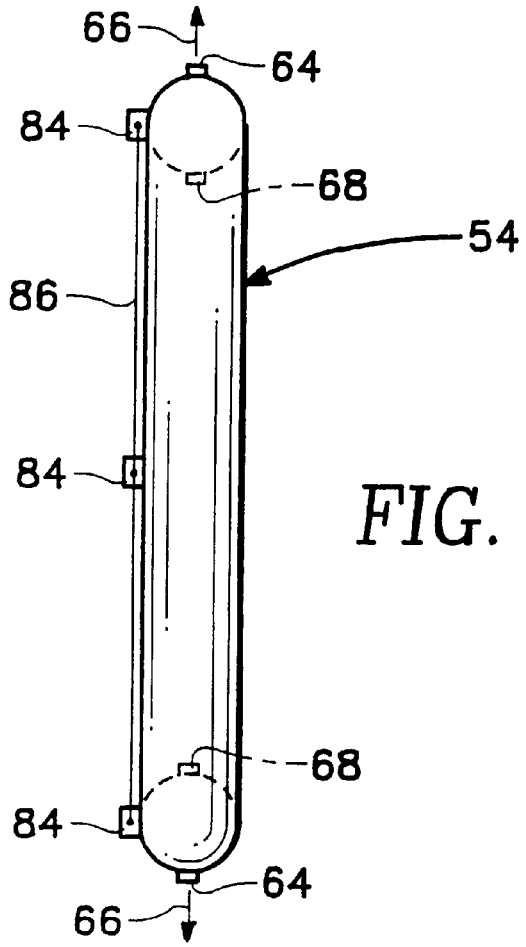

As is best illustrated in FIG. 3C, augmenter 26' may include an ignition source 86 such a heated wire to ignite the natural gas injected in the jet engine's exhaust. Support for ignition source 86 is provided by ceramic standoffs 84 mounted on the backside of tubular injection ring 54.

Figure 4:
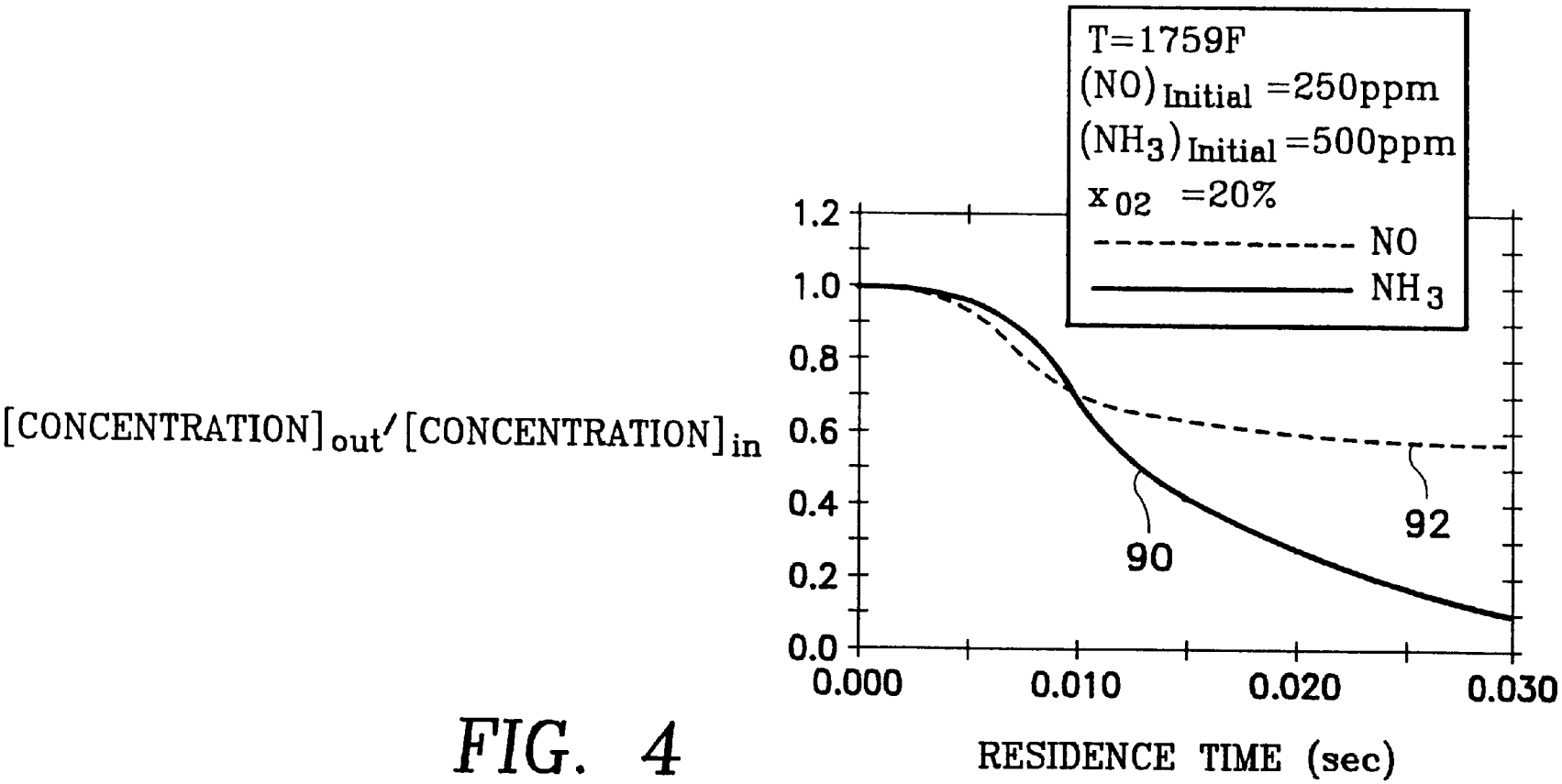
FIG. 4 illustrates plots for NO and $NO_2$ for simulated after reactor conditions for the annular after reactor of FIG. 1

Referring to FIGS. 1 and 4, a reductant such as ammonia ($NH_3$) or related compounds (e.g., urea) may be used to reduce $NO_X$ compounds in the exhaust stream of jet engine 12. By injecting a reductant into the exhaust stream of jet engine 12 when the exhaust is in a temperature range of 1650° F. to 1850° F., $NO_X$ reductions of up to 90% can be achieved in a fraction of a second utilizing the approach defined as selective non-catalytic reduction (SNCR). FIG. 4 illustrates calculated $NO_X$ reductions using selective non-catalytic reduction in an annular after reactor 26 of the type which constitutes the present invention. As shown in FIG. 4, $NO_X$ levels is reduced by 45% in 30 ms of annular after-reactor residence time. For an annular after-reactor residence time 40–50 ms, a reduction of 50% is achievable.

From the foregoing, it may readily be seen that the present invention comprises a new, unique and exceedingly useful annular after reactor for use with a jet engine test cell which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. An apparatus for removing particulate matter and nitrogen oxides from an exhaust stream generated by a jet engine under test, said apparatus comprising:

an annular after reactor aligned axially with a direction of exhaust flow from an exhaust port of said jet engine, said annular after reactor having a cylindrical shaped outer casing, and an interior;

first injecting means located within the interior of said annular after reactor for injecting natural gas into said exhaust stream to remove said particulate matter from said exhaust stream when a temperature for said exhaust stream is raised to a first temperature range;

igniting means positioned adjacent said first injecting means to ignite said natural gas injected into said exhaust stream raising the temperature of said exhaust stream to said first temperature range which removes said particulate matter from said exhaust stream; and second injecting means located within the interior of said annular after reactor downstream from said first injecting means, said second injecting means injecting ammonia into said exhaust stream to remove said nitrogen oxides from said exhaust stream when the temperature of said exhaust stream is within a second temperature range.

2. The apparatus of claim 1 wherein said first and second injecting means each comprise a set of spoke shaped injectors positioned perpendicular to said cylindrical shaped outer casing, each set of said spoke shaped injectors extending inward into the interior of said annular after reactor.

3. The apparatus of claim 1 wherein said first temperature range comprises a temperature range of 1850° F. to 2200° F.

4. The apparatus of claim 1 wherein said second temperature range comprises a temperature range of 1650° F. to 1850° F.

5. The apparatus of claim 1 further comprising a layer of ceramic material positioned inside of said cylindrical shaped outer casing, said layer of ceramic material being affixed to said cylindrical shaped outer casing.

6. The apparatus of claim 1 wherein said first and second injecting means each comprise:

a tubular gas injection ring vertically positioned within the interior of said annular after reactor;

first and second fuel feed lines connected to said tubular gas injection ring, said first and second fuel feed lines providing support for said tubular gas injection ring;

said tubular gas injection ring having a first plurality of equally spaced gas injection nozzles located around an outer circumference thereof and a second plurality of equally spaced gas injection nozzles located around an inner circumference thereof;

a centrally located gas injection device positioned within the interior of said annular after reactor, said gas injection device being aligned with said tubular gas injection ring;

said gas injection device having six equally spaced gas injection nozzles positioned around the circumference thereof; and a third fuel feed line connected to said gas injector device, said third fuel feed line being used to position said gas injection device centrally within the interior of said annular after reactor and to provide support for said gas injection device.

7. An apparatus for removing particulate matter and nitrogen oxides from an exhaust stream generated by a jet engine under test, said apparatus comprising:

an annular after reactor aligned axially with a direction of exhaust flow from an exhaust port of said jet engine, said annular after reactor having a cylindrical shaped outer casing, and an interior;

a layer of ceramic material positioned inside of said cylindrical shaped outer casing, said layer of ceramic material being affixed to said cylindrical shaped outer casing;

a first gas injector located within the interior of said annular after reactor for injecting natural gas into said exhaust stream to remove said particulate matter from said exhaust stream when a temperature for said exhaust stream is raised to a first temperature range of 1850° F. to 2200° F.;

a gas ignition device positioned adjacent said first gas injector to ignite said natural gas injected into said exhaust stream raising the temperature of said exhaust stream to said first temperature range to remove said particulate matter from said exhaust stream; and a second gas injector located within the interior of said annular after reactor downstream from said first gas injector, said second gas injector injecting ammonia into said exhaust stream to remove said nitrogen oxides from said exhaust stream when the temperature of said exhaust stream is within a second temperature range of 1650° F. to 1850° F.

8. The apparatus of claim 7 wherein said first and second gas injectors each comprise a set of spoke shaped injectors positioned perpendicular to said cylindrical shaped outer casing, each set of said spoke shaped injectors extending inward into the interior of said annular after reactor.

9. The apparatus of claim 7 wherein said first and second gas injectors each comprise:

a tubular gas injection ring vertically positioned within the interior of said annular after reactor;

first and second fuel feed lines connected to said tubular gas injection ring, said first and second fuel feed lines providing support for said tubular gas injection ring;

said tubular gas injection ring having a first plurality of equally spaced gas injection nozzles located around an outer circumference thereof and a second plurality of equally spaced gas injection nozzles located around an inner circumference thereof;

a centrally located gas injection device positioned within the interior of said annular after reactor, said gas injection device being aligned with said tubular gas injection ring;

said gas injection device having six equally spaced gas injection nozzles positioned around the circumference thereof; and a third fuel feed line connected to said gas injector device, said third fuel feed line being used to position said gas injection device centrally within the interior of said annular after reactor and to provide support for said gas injection device.

10. The apparatus of claim 7 wherein said gas ignition device comprises a heated wire.

11. An apparatus for removing particulate matter from an exhaust stream generated by a jet engine under test, said apparatus comprising:

an annular after reactor aligned axially with a direction of exhaust flow from an exhaust port of said jet engine, said annular after reactor having a cylindrical shaped outer casing, and an interior;

a layer of ceramic material positioned inside of said cylindrical shaped outer casing, said layer of ceramic material being affixed to said cylindrical shaped outer casing;

a gas injector located within the interior of said annular after reactor for injecting natural gas into said exhaust stream to remove said particulate matter from said exhaust stream when a temperature for said exhaust stream is raised to a temperature range of 1850° F. to 2200° F.; and a gas ignition device positioned adjacent said first gas injector to ignite said natural gas injected into said exhaust stream raising the temperature of said exhaust stream to said first temperature range to remove said particulate matter from said exhaust stream.

12. The apparatus of claim 11 wherein said gas injector comprises a set of spoke shaped injectors positioned perpendicular to said cylindrical shaped outer casing, said set of spoke shaped injectors extending inward into the interior of said annular after reactor.

13. The apparatus of claim 11 wherein said gas injector comprises:

a tubular gas injection ring vertically positioned within the interior of said annular after reactor;

first and second fuel feed lines connected to said tubular gas injection ring, said first and second fuel feed lines providing support for said tubular gas injection ring;

said tubular gas injection ring having a first plurality of equally spaced gas injection nozzles located around an outer circumference thereof and a second plurality of equally spaced gas injection nozzles located around an inner circumference thereof;

a centrally located gas injection device positioned within the interior of said annular after reactor, said gas injection device being aligned with said tubular gas injection ring;

said gas injection device having six equally spaced gas injection nozzles positioned around the circumference thereof; and a third fuel feed line connected to said gas injector device, said third fuel feed line being used to position said gas injection device centrally within the interior of said annular after reactor and to provide support for said gas injection device.

14. The apparatus of claim 11 wherein said gas ignition device comprises a heated wire.

* * * * *